US010597925B1

(12) United States Patent
Boor

(10) Patent No.: US 10,597,925 B1
(45) Date of Patent: Mar. 24, 2020

(54) MECHANICAL MONO-FOLD DOOR

(71) Applicant: Lester Buildings, LLC., Lester Prairie, MN (US)

(72) Inventor: Paul A. Boor, Hutchinson, MN (US)

(73) Assignee: Lester Building Systems, LLC, Lester Prairie, MN (US)

( * ) Notice: Subject to any disclaimer, the term of this patent is extended or adjusted under 35 U.S.C. 154(b) by 105 days.

(21) Appl. No.: 15/674,422

(22) Filed: Aug. 10, 2017

Related U.S. Application Data

(60) Provisional application No. 62/373,014, filed on Aug. 10, 2016.

(51) Int. Cl.
*E05F 11/00* (2006.01)
*E05F 15/627* (2015.01)
*E05F 15/616* (2015.01)

(52) U.S. Cl.
CPC ..... *E05F 15/627* (2015.01); *E05F 15/616* (2015.01); *E05Y 2900/106* (2013.01); *E05Y 2900/132* (2013.01)

(58) Field of Classification Search
CPC . E05F 15/627; E05F 15/616; E05F 2900/132; E05F 2900/106
USPC ..... 49/325, 339, 340, 341, 344, 347, 356, 49/197, 199, 200, 203, 204
See application file for complete search history.

(56) References Cited

U.S. PATENT DOCUMENTS 1,273,923 A * 7/1918 Prescott ..... 160/193
1,275,591 A * 8/1918 Ogden et al. ..... 160/189
1,386,192 A * 8/1921 McCloud ..... E05D 15/583 16/DIG. 31
1,579,677 A * 4/1926 Tomkinson ..... E05D 15/583 160/189
4,019,442 A * 4/1977 Lee ..... B60P 7/14 16/400
4,248,016 A * 2/1981 Pecchioni ..... E05F 15/684 49/199
4,637,446 A * 1/1987 McQueen ..... E05D 15/262 160/207
5,020,580 A * 6/1991 Dalman ..... E05D 15/262 160/188
5,572,829 A * 11/1996 Stoltenberg ..... E05D 15/165 49/200

(Continued)

FOREIGN PATENT DOCUMENTS

FR 3000516 A1 * 7/2014 ..... E05D 15/38

*Primary Examiner* — Jerry E Redman
(74) *Attorney, Agent, or Firm* — Glen E. Schumann; Moss & Barnett

(57) ABSTRACT

The monolithic door of the present invention includes a single panel door having a top edge and a front and back side. The door is hinged at the top edge, within a door opening, to a building structure (in one embodiment, a door frame header). A first cam style winding mechanism is secured towards the top of a first vertical member of the door frame and a second winding mechanism is secured towards the top of a second vertical member of the door frame, opposite the first vertical member. A compression strut on each side of the door is secured to tension straps or cables which are in turn attached to a corresponding winding mechanism secured to the building structure. An actuator operatively connected to the winding mechanisms rotates the drums to either to force the door open or allow the door to close.

15 Claims, 6 Drawing Sheets

(56) References Cited

U.S. PATENT DOCUMENTS

| | | | | |
|---|---|---|---|---|
| 5,588,258 | A * | 12/1996 | Wright | E05F 15/627 49/340 |
| 9,593,525 | B1 * | 3/2017 | Morris | E06B 3/483 |
| 10,253,543 | B2 * | 4/2019 | Newman | E05F 11/48 |
| 2002/0029524 | A1 * | 3/2002 | Kerkvliet | E05D 11/00 49/200 |
| 2012/0222825 | A1 * | 9/2012 | Taddei | E06B 3/483 160/223 |
| 2012/0313495 | A1 * | 12/2012 | Fan | H05K 7/1497 312/319.7 |
| 2013/0319623 | A1 * | 12/2013 | Crown | E06B 3/483 160/224 |
| 2014/0373451 | A1 * | 12/2014 | Betker | E05D 15/38 49/199 |
| 2015/0368950 | A1 * | 12/2015 | Baczweski | E05D 15/445 49/200 |
| 2016/0333629 | A1 * | 11/2016 | Betker | E06B 3/38 |
| 2016/0376830 | A1 * | 12/2016 | Crown | E06B 1/522 49/199 |
| 2017/0016259 | A1 * | 1/2017 | Schweiss | E05D 13/1223 |
| 2017/0074019 | A1 * | 3/2017 | Schweiss | E05D 13/1223 |
| 2018/0283084 | A1 * | 10/2018 | Schweiss | E05F 15/605 |

* cited by examiner

| Door Type | Space req. (in) | | Time | Cost for Width | | | Width (ft) | | Energy | Auto- |
|---|---|---|---|---|---|---|---|---|---|---|
| | Head | Side | (sec.) | <16' | 16' - 26' | >26' | Practical | Max | Efficiency | mation |
| Over Head | 12 - 32 | 6 | 30 | low | Medium | High | 24 | 32 | Medium | Yes |
| Slider | 0 | =Width | 120 | low | Low | Low | 40 | 48 | Low | Minimal |
| Bi-Fold | 24 - 36 | 6 | 60 | Medium | Medium | Medium | 60 | 80+ | Med-Hi | Yes |
| Mono-Fold Hydraulic | 0 | 6 | 120 | High | High | High | 60 | 80+ | High | Yes |
| Mono-Fold Mechanical | 0 | 6 | 60 | Medium | Medium | Medium | 60 | 80+ | High | Yes |

FIG. 4

MECHANICAL MONO-FOLD DOOR

REFERENCE TO RELATED APPLICATIONS

This application claims the benefit of Provisional Application No. 62/373,014, filed Aug. 10, 2016. The contents of which are incorporated herein by reference.

FIELD OF THE INVENTION

The present invention is related to single panel, top hinged doors (hereafter designated mono-fold doors) and a method of opening and closing the door.

BACKGROUND OF THE INVENTION

There are several types of large doors currently in frequent use, including: overhead doors, sliding doors, bi-fold doors, and hydraulic mono-fold doors.

Overhead doors ("OHDs") are formed by 18'-24" tall by various door width segments that are stacked vertically into a track system that is mounted to the building at the door sides. The track curves into the building above the door opening. Typically, a minimum of 12" of headroom is required above the door opening; very large OHDs require as much as 36" of headroom. OHDs frequently include a torsion spring to counter balance door weight. The spring stores energy as the door is closed and releases it as the door opens, thus minimizing the effort required to open the door and reducing closing force. OHDs are often combined with an electric motor and controls that allow the door to be opened remotely. The horizontal seams inherent in OHD panels and the sliding that occurs at door sides often result in significant air infiltration and significant energy losses. OHDs are very competitive when the doors are less than 16' wide; they become relatively expensive when they are wider than 24' and widths greater than 30' are possible but the cost increases rapidly.

Sliding doors are nearly always the lowest cost door option, are notoriously difficult to insulate and weather-strip, require no or very minimal headroom, require substantial side room making them impractical when continuous openings are required, and can be accessorized in a manner similar to the walls which they resemble. Double sliding doors up to 40' wide×20' tall are common. Walk doors, windows and a variety of finish materials can be incorporated into a sliding door. Sliding doors that include cross bucks and windows are often used to improve aesthetics of the building.

Sliding doors are available in a number of styles, the most common include single and double sliders. A third style of sliding door that is not as common is referred to as a "quad door." The sliding door is formed by building a light frame and covering that frame with corrugated steel sheathing. The assembly is very similar to the building wall; the wall segments or "door leaves" are then suspended from rollers running in a horizontal track located above the door. Sliders can occur on the inside or outside of the building wall.

Bi-Fold Doors consist of two full width door segments. In one embodiment, welded tube steel frames sheathed with the same material as the building wall are typically used to form door panel segments. The upper segment is hinged to the building at the top and the lower segment at the bottom. The lower segment is hinged to the upper segment at the top. Rollers located at and typically extending laterally from the bottom corners of the bottom segment engage vertical tracks mounted to the building at the sides of the door opening.

Cables or straps are attached to the bottom and top of the door at intervals across the doors width. A winding mechanism shortens the cables or straps' causing the bottom to be lifted toward the top of the door, while the center of the door pushes out as the door is opened.

In the door open position, the bottom bi-fold panel typically hangs 24"-30" below the hinges mounted at the top of the bottom panel, limiting the available doorway height. Bi-fold doors can be insulated like the building's walls but weather stripping is somewhat difficult because of the lift/sliding motion of the door relative to the door jamb, and the steel frame creates thermal shorts that can significantly impact thermal performance.

Hydraulic Mono-Fold doors use a pair of hydraulic cylinders to open a single monolithic door slab hinged at the top of the slab to a door frame or header. The cylinders are located so that the door is forced to swing away from the building as the cylinders are extended. Only the perimeter of Mono-Fold doors needs to be weather stripped. The door moves directly away from the door jamb which allows effective weather stripping.

The door can be insulated and accessories such as electricity and light can be added to the door much like a stationary wall.

The hydraulic system used to power mono-fold doors is noisy, messy, expensive, and unreliable, cold weather negatively impacts door speed, thermal lock can prevent the doors from opening or closing and it is difficult to force the doors to open level relative to the height of the door.

Storage and manufacturing buildings often require large doors to allow efficient movement of materials and equipment into and out of the structure. The ideal door would provide all of the following features: No head room requirement, minimal side room requirements, the doors should be able to open and close effectively, quickly and safely, low cost, easy incorporation of accessories, including, but not limited to windows and walk doors and it would be easy to insulate and effectively weather-strip.

SUMMARY OF THE INVENTION

The present invention is a mechanical mono-fold door that takes the physical attributes resulting from a single monolithic door slab and combines it with the low cost and reliability of a simple mechanical drive system.

The monolithic door of the present invention includes a single panel door having a top edge and a front and back side. The door is hinged at the top edge, within a door opening, to a building structure (in one embodiment, a door frame header).

In one preferred embodiment, a first winding mechanism is secured towards the top of a first vertical member of the door frame and a second winding mechanism is secured towards the top of a second vertical member of the door frame, opposite the first vertical member. A first tension strap is mounted at a first end to the first winding mechanism. A second end of the first tension strap is connected to a first, "lower" end of a compression strut.

A first end of a second tension strap is also secured to the first winding mechanism and the second tension strap is wound around guide sheaves mounted on the building structure (in one embodiment, the building structure is a vertical door frame member). A guide sheave may be fixed or rotatably mounted. A second end of the second tension strap is secured to a second, "upper" end of the compression strut.

The same configuration of tension straps and strut are applied to the second winding mechanism.

In this configuration, the first lower end of the compression struts are in contact with the back side of the door.

An actuator is secured to the building structure in operative engagement with the winding mechanism to rotate the drum. In one preferred embodiment, the actuator is an electric motor with a worm gear that engages a corresponding bull gear of the winding mechanism to rotate the winding drum 29.

Winding the tension straps on their respective winding mechanism causes the first end of the compression strut to be drawn up the back side of the door, causing the door to move upward to an open position. Unwinding the tension straps causes the first end of the compression struts to move down the back side of the door, allowing the door to lower to a closed position.

Strategically placed guide sheaves are attached to the building structure to guide movement of the tension straps and the force applied by the tension straps to the strut.

A cam style winding mechanism can also be utilized to optimize door operating parameters such as door speed as well as power and torque requirements.

In one alternate embodiment, only one winding mechanism is required to open and close a door.

In another alternate embodiment, one continuous tension strap can be utilized with each winding mechanism. A first end of the strap is connected to a first "lower" end of the compression strut, the strap is secured at some point along its length to the winding mechanism, and a second end of the strap is secured to a second "upper" end of the compression strut.

The strut, strap/cable and winding mechanism replace the hydraulic system currently employed on mono-fold doors.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

FIG. 4 is a table illustrating typical characteristics of various types of doors;

DETAILED DESCRIPTION OF THE INVENTION

The monolithic door of the present invention is designed for use in a typical building doorway or window frame. Two framing systems are typically used with the door of the present invention (although other framing arrangements are possible). A first framing system has girts that span the full width of the door attaching to a single vertical at each end. A second framing system includes interior vertical framing members that are attached to a truss or beam that spans the full width of the door. The embodiments described herein are described using the first framing system.

Figure 1:
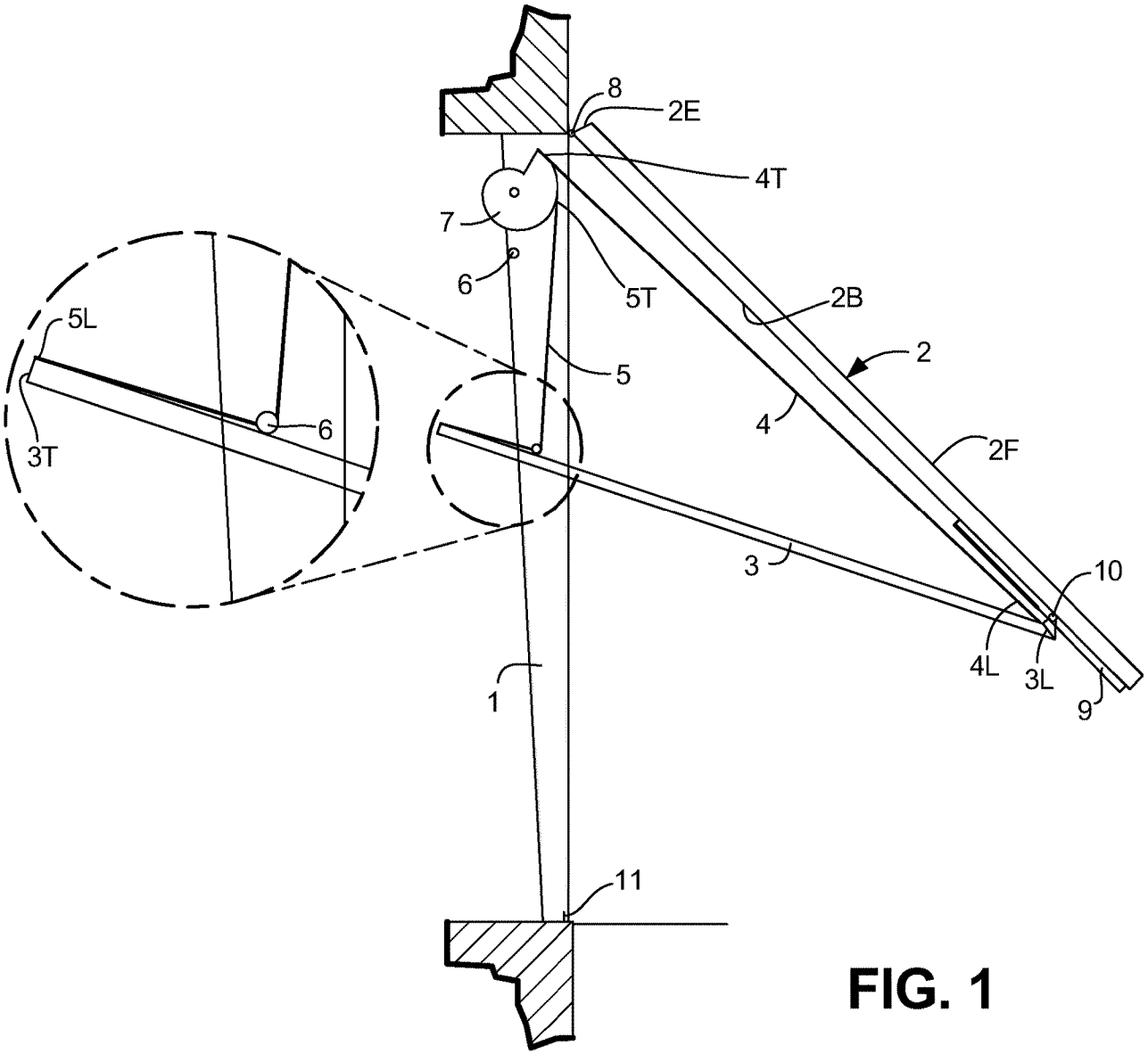
FIG. 1 is a side view of a first preferred embodiment of the present invention, illustrating the orientation of the winding mechanism, compression strut, tension straps and door, when the door is in a partially open position.

Referring to the embodiment of FIG. 1, door jamb column 1 provides the static structure that supports the active components of the door opening system. The jamb column is integral to the building structure, the door opener and the door. The jamb column can be made from wood, steel or other suitable material. The jamb column can be a single element with the opening mechanism mounted on one side, or a pair of elements spaced some distance apart with the operating mechanism located between the spaced jamb columns. Typically two operating mechanisms are used. One mechanism is mounted on each of the jamb columns located on either side of the door. (A single mechanism located on one side of the door may be used for narrow doors.)

Door 2 is a single slab or panel that may be field assembled from individual framing members much like a building wall or be factory assembled and be delivered as a welded frame. Sheathing and insulation is typically installed on the door in the field. The door slab includes a top edge 2E, a front side 2F and a back side 2B. The door is hinged at the top edge 2E to a girt as shown at 8 in FIG. 1. Door 2 pivots out from the building. A latch plate 11, shown as located at the bottom of the jamb column in FIG. 1 (but other locations are possible), secures the door in its closed position.

In one preferred embodiment, a first winding mechanism 7 is secured towards the top of a first jamb column 1 and a second winding mechanism 7 is secured towards the top of a second jamb column 1, opposite the first jamb column. (However, it is anticipated that any number of winding mechanisms might be strategically placed to open and close the door.)

The winding mechanism is a shaft, spool, bar or drum to which tension straps are attached by known means, that is rotated, typically by a motor via speed reducing gearing, chains, or belts (although other power sources including manual inputs can be used), such that the tension straps wrap around the winding mechanism thereby shortening the strap. This in turn activates the compression strut 3 (causing the struts to move and act upon the door) to open the associated door, or the tension straps 4 are unwound from the shaft spool or drum to allow the associated door to close.

The winding mechanism can be sized such that less than one revolution is required to fully open the door. In this case the drum does not need to be circular—it can have a cam or other shape. For instance, the local radii can vary such that the winding surface forms a logarithmic curve similar to a snail shell. Reducing the wrap radii as the door opens can offset the increasing moment arm of the door such that, for a constant rotational velocity of the drum, input power is constant.

In one embodiment, shown in FIG. 1, a leading end 4L of a first or "leading" tension strap 4 is connected to a first "lower" or "lead" end 3L of the compression strut 3. A trailing end 4T of tension strap 4 is connected to the drum 7 by known means. A trailing end 5T of a trailing strap 5 is also attached to the drum 7 by known means. Trailing strap 5 winds around strategically placed guide sheaves 6 mounted on the building structure (in one embodiment, a vertical jamb column) and a leading end 5L of strap 5 is secured to a second "upper" or trailing end 3T of the compression strut 3. (Tension strap 5 starts at the winding mechanism, passes to the right and around the bottom of the guide sheaves 6 as shown in FIG. 1, continuing parallel to the top side of compression strut 3, and finally attaches to the very end 3T of compression strut 3 by known means.) In this arrangement, the first lower or lead end 3L of the compression strut 3 is in contact with the back side 2B of the door 2. (As stated above, in an alternate embodiment, one continuous tension strap can be utilized with each winding mechanism. A first end of the strap is connected to a first "lower" end of the compression strut, the strap is secured at some point along its length to the winding mechanism, and a second end of the strap is secured to a second "upper" end of the compression strut.)

The straps shorten as the winding mechanism turns and winds the straps on the drum, pulling the leading end of the compression strut up the back side of the door. This causes the door to move to its open position. Reversing the direction of the winding mechanism causes the straps to unwind, allowing the door to move to its closed position.

The strategically placed guide sheaves 6 are used to redirect the tension straps such that the tension force vectors will force the compression strut 3 down and out (in the direction of the back side of the door 2B) to open the door 2. In operation, the trailing end 5T tension strap 5 is redirected by the guide sheave 6 such that pulling up on the trailing end 5T of the tension strap draws the trailing end 3T of the compression strut 3 towards the guide sheave 6, pushing the leading edge 3L of the compression strut 3 into and upward against the back side 2B of the door 2, causing the door to open.

When using more than one mechanism to open a door, such as the door opening of the present invention mounted on opposing door jamb columns, synchronization can be ensured via a connecting rod that forces the two winding mechanisms to turn in unison. Conversely, independent servo motors can be located at each side of the door and programmed to wind independent hubs simultaneously.

Figure 3:
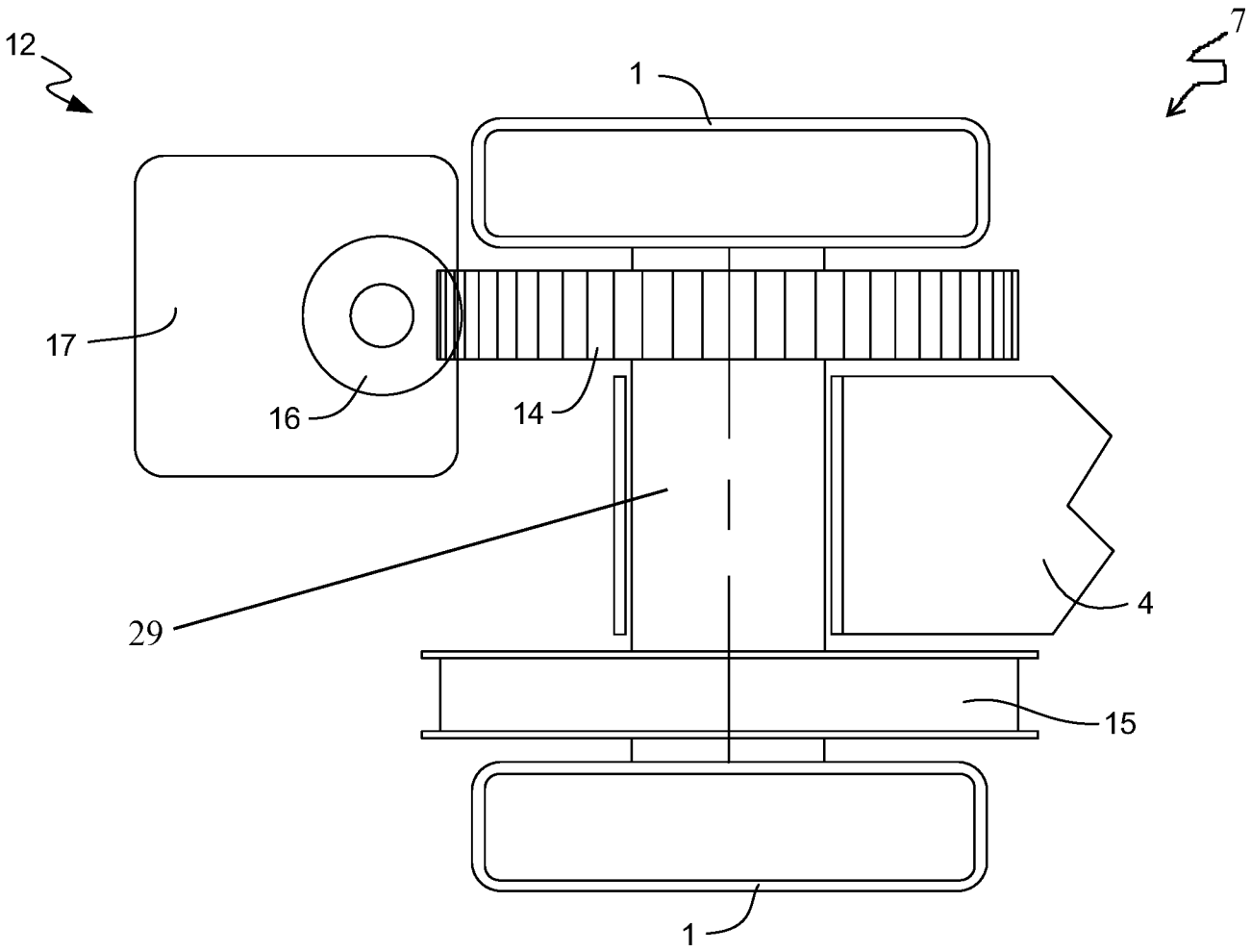
FIG. 3 is a top view of the winding mechanism and actuator.

As shown in FIG. 3, an actuator 12 including a Numerically Controlled Servo Motor with Speed Reducer 17 is secured to the building structure in operative engagement with the winding mechanism 7. In one preferred embodiment, the actuator 12 is an electric motor with a worm gear 16 that engages a corresponding bull gear 14 of the winding mechanism to rotate the winding drum 29. A counter balance guide sheave is added as shown at 15.

FIG. 3 shows a circular winding mechanism although a cam could be used. The cam arrangement of the winding mechanism allows the movement of the tension strap(s) 4 to optimize door operating parameters and enabling secondary operations such as latching the door.

Counter weights (not shown) can be incorporated by winding another tension strap or cable around the winding mechanism in the opposite direction of the door strap(s) such that as the door opens the counter weight descends. The addition of counter weights reduces input power requirements and the size of drive components.

Both the leading and trailing tension straps can be connected to a common winding mechanism or multiple winding mechanisms can be utilized, one for each strap. Separate winding mechanisms allow independent operation of the tension straps. Independent strap operation allows more complex movement of the compression strut 3 enabling ancillary benefits such as door latching. Using servo motors allows full coordination between all four straps associated with a single door. As with a single winding mechanism, when using separate winding mechanisms for each strap, winding the tension straps on their respective winding mechanisms causes the leading end 3L of the compression strut 3 to be drawn up the back side of the door 2B while the trailing end 3T is being pulled toward the guide sheave forcing the compression strut into the back side of the door and the door to open. The combined effect of the two straps is to force the compression strut 3 to press against the door 2 as the tension straps rotate about or slide by the guide sheaves 6 in FIG. 1. The leading end 3L of the compression strut 3 follows a curved, upward path outside the building as it forces the door open. Unwinding the tension straps causes the leading end 3L of the compression struts 3 to move down the door 2 while the strut moves into the building, allowing the door to lower to a closed position.

Figure 5C:
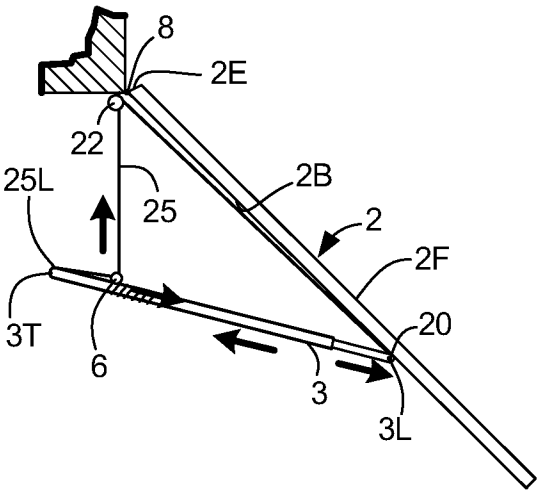
FIG. 5C is yet another alternate embodiment of the present invention.

Alternate embodiments of the invention are possible. One such embodiment, referred to as the "single active end" embodiment, is illustrated in FIG. 5A. The leading end 3L of the compression strut 3 is hinged to the door at 20. Hence the leading end of the compression strut 3L does not move with respect to the door. All of the door's motion is achieved by moving the trailing end 3T of the compression strut 3 with the tension strap 25 upon actuation of winding mechanism 22. A guide sheave is shown at 6, which operates in a similar fashion as was described in paragraph 44 of this specification.

Figure 5B:
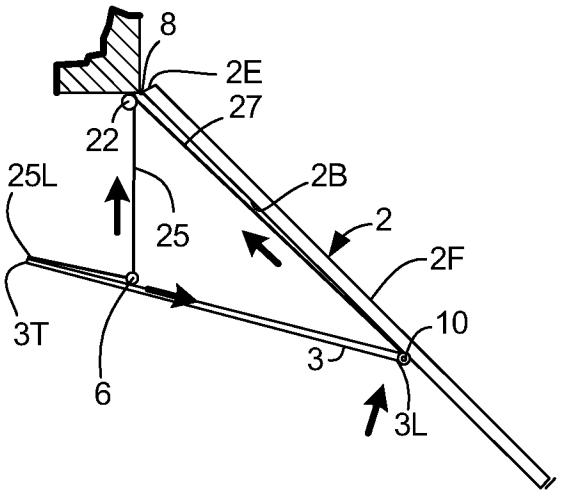
FIG. 5B is yet another alternate embodiment of the present invention.
Figure 5A:
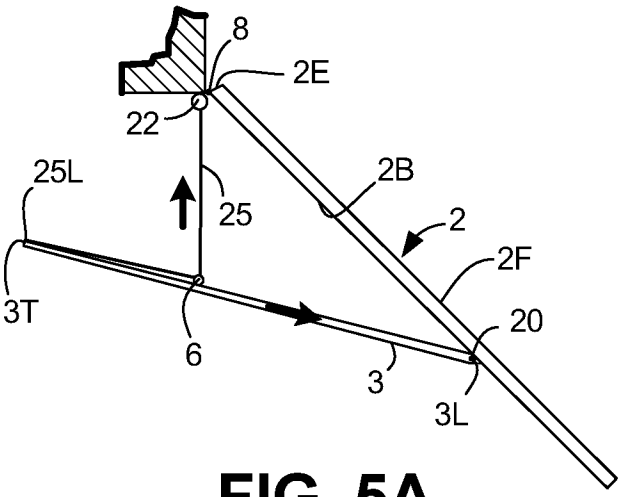
FIG. 5A is an alternate embodiment of the present invention.

In another preferred embodiment, referred to as the "double active end" embodiment, is illustrated in FIG. 5B. A pair of tension straps 25 and 27 cause both ends of the compression strut 3 to move. The leading end 3L of the compression strut 3 includes a roller 10 that rolls up and down the back side 2B of the door slab. The leading end of the compression strut 3 is near the bottom of the door 2 when the door is in the closed position. The leading end of the compression strut is pulled up the back side 2B of the door 2 and out from the building forcing the door open. The compression strut 3 is attached to the building only via the tension straps and is suspended and moved via these straps.

Figure 2:
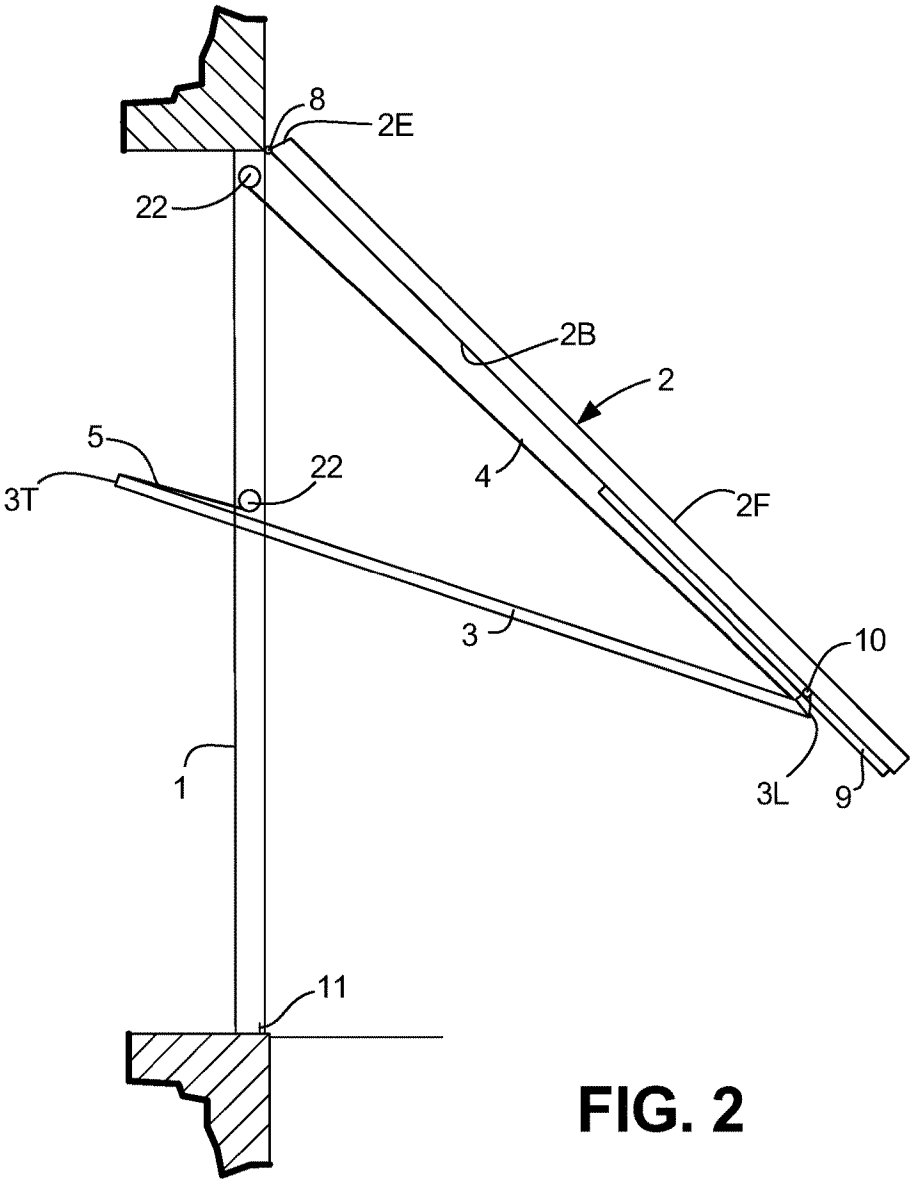
FIG. 2 is a side view of a second preferred embodiment of the present invention, illustrating the orientation of the winding mechanism, compression strut, tension straps and door, when the door is in a partially open position.

Another preferred embodiment shown in FIG. 2, like the double active end embodiment, utilizes a roller 10 that engages a track or guide 9 located on the back side 2B of the door 2 slab. In one embodiment, the track may include an outer wear surface and the roller 10 rolls up and down the wear surface. In another embodiment, the roller 10 will be mounted on or in track or guide 9 to roll up and down the track. This embodiment in FIG. 2 is shown with two independent winding mechanisms 22, each connected to a corresponding strap.

Another preferred embodiment shown in FIG. 5C, referred to as the telescoping compression strut embodiment, is similar to the single active end case except that the compression strut 3 is telescopic, lengthening as the trailing end 3T of the compression strut 3 is drawn toward the pivot point 8. This allows the use of a more compact strut.

Figure 6A:
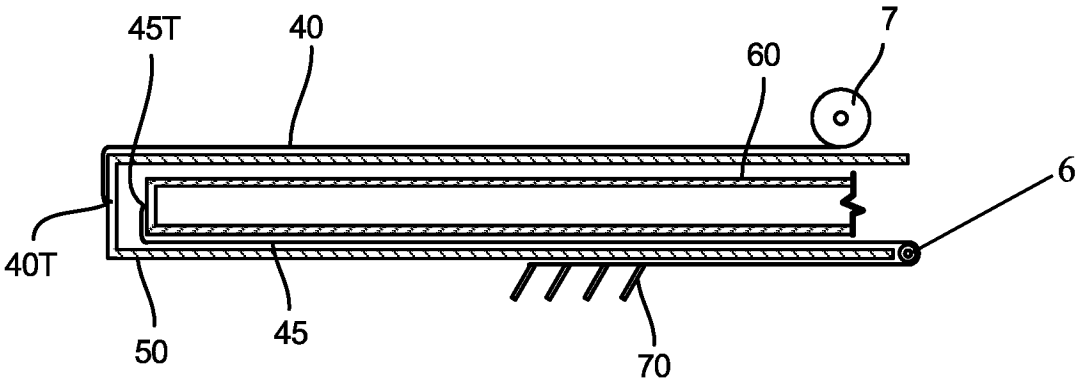
FIG. 6A is a cut away of a portion of a first embodiment of a telescoping strut arrangement, with the telescoping strut in a retracted position.
Figure 6B:
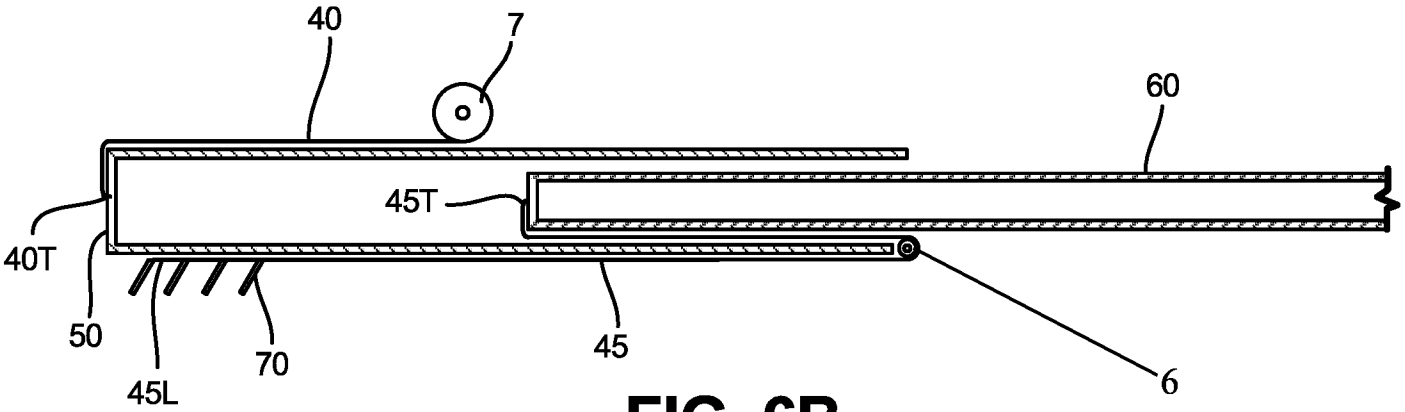
FIG. 6B is the telescoping strut of 6A in an extended position.

FIGS. 6A and 6B disclose two embodiments (of many possible) telescoping arrangements.

A partial sectional of a telescoping strut is shown in FIG. 6A. The telescoping strut includes an inner strut member 60 mounted within an outer strut member 50. Secured at a first end to winding mechanism 7 is a first strap or cable 40. A second or trailing end 40T of strap 40 is secured to the end of outer strut member 50. A second strap or cable 45 is secured at a trailing end 45T to the inner end of the inner strut 60. The opposite end of strap 45 is secured to a vertical column of the door opening or building structure 70. Not shown, the door is mounted to the right of the partial telescoping strut shown in FIG. 6A.

A roller or guide sheave 6 is secured to an outer edge of the outer strut member 50 as shown in FIG. 6A. Cable or strap 45 winds from the end of the inner strut member 60 over the guide sheave 6 to the building structure 70.

In operation, when cable 40 is wound on the winding mechanism 7, the outer strut member is drawn towards the winding mechanism, in the direction of the mounted door. (An outer end (not shown) of inner strut 60, opposite of the inner end of inner strut 60 (at 40T), is in engagement with the door). Because the length of strap 45 is fixed, and one end of the strap 45 is secured to the building structure 70, movement of the outer strut in the direction of the door causes the inner strut 60 to be drawn out and extend from the outer strut 50, as shown in FIG. 6B. Telescoping of the strut pushes the door to its open position. In an alternative embodiment, instead of securing strap 45 to the building structure 70, strap 45 can be attached to another winding mechanism located on the building structure and strap 45 can be wound on the winding mechanism to cause it to extend outward from the outer strut 50.

These embodiments are not limiting as any combination of guide sheaves, winding mechanisms, straps and struts are anticipated by the present invention. One end of the strut can be hinged to the door or the building, or both ends of the strut can be pulled by the strap/cable. The end(s) of the strut that are not pinned can follow a track or can be allowed to "float" in the position dictated by force equilibrium.

Finally, components identified above as being attached to vertical columns of the doorway or the doorway header may be attached to other building structures and surfaces as may be suitable for operation of the door opening and closing mechanism and door.

The invention claimed is:

1. A door opener mechanism for opening and closing a top hinged mono-fold door having a back surface, the mono-fold door being mounted within a building opening by a door frame, the door frame defined by two spaced vertical members and a header supported in a generally horizontal orientation mounted between or above the vertical members, the mono-fold door being rotatably mounted to the header, the door opener mechanism comprising:

a. a winding mechanism to be secured to the building or door frame, the winding mechanism including means for engaging a cable or strap, a winding drum on which a cable or strap can be wound and means for operatively engaging an actuator;

b. a strut having a leading end for slidably engaging the back surface of the mono-fold door and an opposite suspended trailing end of the strut;

c. at least one cable or strap having means for engaging the winding drum, a first end for engaging the strut at or near the leading end of the strut, and a second end for engaging the strut at or near the trailing end of the strut;

d. an actuator operatively engaging the winding drum, the actuator including means for rotating the winding drum, such that when the winding drum is rotated in a first direction, the cable or strap winds up on the winding drum, causing the leading end of the strut to slidably engage the back side of the mono-fold door to rotate the mono-fold door upward to an open position, and when the winding drum is rotated in an opposite second direction, the cable or strap unwinds from the winding drum, causing the leading end of the strut to drop, allowing the mono-fold door to rotate downward to a closed position.

2. A door opening mechanism for opening and closing a top hinged mono-fold door having a back surface, the mono-fold door being mounted within a building opening by a door frame including two spaced vertical members having a top and bottom end, and a header supported in a generally horizontal orientation mounted between or above the vertical members, the mono-fold door being rotatably mounted to the header, the door opening mechanism comprising:

a. a winding mechanism to be the building or door frame, the winding mechanism including means for engaging at least one cable or strap, a winding drum on which the cable or strap can be wound and means for operatively engaging an actuator;

b. a strut having a leading end for slidably engaging the back surface of the mono-fold door and an opposite suspended trailing end;

c. a first cable or strap having a first end the winding drum and a second end secured at or near the leading end of the strut, and a second cable or strap having a first end the winding drum and a second end secured at or near the trailing end of the strut;

d. an actuator operatively engaging the winding drum, the actuator including means for rotating the winding drums mechanism, such that when the winding drums is rotated in a first direction, the first and second cable or strap wind up on the winding drum, causing the leading end of the strut to slidably engage the back side of the mono-fold door to rotate the mono-fold door upward to an open position, and when the winding drums is rotated in an opposite second direction, the cable or strap unwind from the winding drums, causing the leading end of the strut to drop, allowing the mono-fold door to rotate downward to a closed position.

3. The door opening mechanism of claim 2 further comprising guide sheaves selectively positioned and the first and second vertical members to direct the force applied by the cable or strap to the struts to maximize the efficiency of the door opening and closing.

4. The door opening mechanism of claim 2 wherein a track is mounted on the back side of the mono-fold door and the leading end of the strut slidably engages the door via a hinge or vertical track.

5. A door opening mechanism for opening and closing a top hinged mono-fold door having a back surface, the mono-fold door being mounted within a building opening by a door frame defined by first and second spaced vertical members and a header mounted in a generally horizontal orientation between or above the vertical members, the mono-fold door being rotatably mounted to the header, the door opening mechanism comprising:

a. a first winding mechanism secured to the building or the door frame on the side of the first vertical member, the first winding mechanism including means for engaging at least one cable or strap, a winding drum on which one or more the cable or strap can be wound, and means for operatively engaging a first actuator;

b. a first strut having a leading end for slidably engaging the back surface of the mono-fold door and an opposite trailing end;

c. a first cable or strap having means for engaging the first winding drum, a first end for engaging the leading end of the first strut at or near the leading end of the first strut, and a second end for engaging the trailing end of the second strut, at or near the trailing end of the second strut;

d. a first actuator operatively engaging the first winding drum, the first actuator including means for rotating the winding drums;

e. a second winding mechanism secured to the building or the door frame on the side of the second vertical member, the second winding mechanism including means for engaging at least one cable or strap, a winding drum on which a second cable or strap can be wound and means for operatively engaging a second actuator;

f. a second strut having a leading end for slidably engaging the back surface of the mono-fold door and an opposite trailing end;

g. a second cable or strap having means for engaging the second winding drum, having a first end for engaging the leading end of the second strut at or near the leading end of the second strut, and a second end of the second strut for engaging the trailing end of the second strut, at or near the trailing end of the second strut;

h. a second actuator operatively engaging the second winding drum, the second actuator including means for rotating the second winding drum; and i. wherein, when the first and second winding drums are rotated in a first direction, the first and second cable or strap wind up on their corresponding first and second winding drums, causing the leading edges of the first and second struts to slidably engage the back side of the door to rotate the mono-fold door to an open position, and when the winding drums of the first and second winding mechanisms are rotated in an opposite second direction, the first and second cable or strap unwind from their respective winding drums, causing the leading ends of the first and second struts to drop, allowing the mono-fold door to rotate to a closed position.

6. The door opening mechanism of claim 5 further comprising a rod connected to the two winding drums to ensure they turn in unison.

7. The door opening mechanism of claim 5 wherein the strut is formed from wood or steel.

8. The door opening mechanism of claim 5 wherein a counter weight is the winding drum.

9. The door opening mechanism of claim 5 wherein the lead end of the strut includes a roller that fits into a track mounted on the back side of the door panel.

10. The door opening mechanism of claim 5 wherein the struts are telescoping.

11. The door opening mechanism of claim 5 further comprising guide sheaves mounted on the vertical members to engage the second and fourth cable or strap, the guide sheaves being spaced a distance from the trailing ends of the first and second struts, so that when the cable or strap are wound on the winding drum, a force acts upon the trailing ends of the struts to push the leading ends of the struts into the back side of the door to open it.

12. The door opening mechanism of claim 5 wherein the struts are attached to tension straps such that both ends of the struts move in unison.

13. The door opening mechanism of claim 5 wherein the leading end of the struts travel in a track and the trailing ends of the struts are suspended by the cable or strap and move in a path dictated only by force equilibrium.

14. The door opening mechanism of claim 5 wherein the winding mechanisms include a cam sized and shaped to maintain near constant input power throughout the door opening sequence.

15. A door opening mechanism for opening and closing a top hinged mono-fold door having a back surface, the mono-fold door being mounted within a building opening by a door frame defined by first and second spaced vertical members and a generally horizontally oriented header positioned above the vertical members, the mono-fold door being rotatably mounted to the header, the door opening mechanism comprising:

a. a first winding mechanism the building or the door frame on the side of the first vertical member, the first winding mechanism including means for engaging at least one cable or strap, a winding drum on which a cable or strap can be wound and means for operatively engaging a first actuator;

b. a first strut having a leading end for slidably engaging the back surface of the mono-fold door and an opposite suspended trailing end;

c. a first cable or strap having a first end the first winding drum and a second end secured near or to the leading end of the first strut, and a second cable or strap having a first end the winding drum and a second end secured at or near the trailing end of the first strut;

d. a first actuator operatively engaging the first winding drum, the first actuator including means for rotating the winding drum;

e. a second winding mechanism the building or the door frame on the side of the second vertical member, the second winding mechanism including means for engaging at least one cable or strap, a winding drum on which a second cable or strap can be wound and means for operatively engaging a second actuator;

f. a second strut having a leading end for slidably engaging the back surface of the mono-fold door and an opposite suspended trailing end;

g. a third cable or strap having a first end the winding drum of the second winding mechanism and a second end secured at or near a leading end of the second strut, and a fourth cable or strap having a first end the second drum and a second end secured at or near a trailing end of the second strut;

h. a second actuator operatively engaging the second winding drum, the second actuator including means for rotating the second winding drum; and i. wherein, when the first and second winding drums are rotated in a first direction, the first and second cable or strap wind up on their respective winding drums, causing the leading edges of the first and second struts to slidably engage the back side of the door to rotate the mono-fold door to an open position, and when the winding drums of the first and second winding mechanisms are rotated in an opposite second direction, the first and second cable or strap unwind from their respective winding drums, causing the leading ends of the first and second struts to drop, allowing the monofold door to rotate to a closed position.

* * * * *